US005473789A

United States Patent [19]

Oster

[11] Patent Number: 5,473,789

[45] Date of Patent: Dec. 12, 1995

[54] DISPOSABLE TOILET SEAT CLEANING PAD

[76] Inventor: Alan L. Oster, 4455 Montego Ave., Box 16, Fargo, N. Dak. 58103

[21] Appl. No.: 139,270

[22] Filed: Oct. 18, 1993

[51] Int. Cl.[6] ..... A47L 13/19

[52] U.S. Cl. ..... 15/104.94; 15/227

[58] Field of Search ..... 15/104.94, 227, 15/118; 206/233, 494

[56] References Cited

U.S. PATENT DOCUMENTS

| | | | |
|---|---|---|---|
| 1,231,168 | 6/1917 | Jones | 15/227 |
| 1,551,416 | 8/1925 | Marshall . | |
| 1,782,502 | 11/1930 | Crane | 15/227 |
| 1,941,320 | 12/1933 | Pamplin | 15/227 |
| 1,999,753 | 4/1935 | Diemer | 15/227 |
| 2,179,614 | 11/1939 | Cohen | 15/227 |
| 2,210,754 | 8/1940 | Frank | 15/227 |
| 2,233,686 | 3/1941 | Topjian | 15/227 |
| 2,621,784 | 12/1952 | Van Boytham . | |
| 2,762,158 | 9/1956 | Duffey . | |
| 2,782,912 | 2/1957 | Humphrey | 15/227 |
| 2,790,982 | 5/1957 | Schneider | 15/118 |
| 2,999,265 | 9/1961 | Duane et al. . | |
| 3,183,543 | 5/1965 | Worcester | 15/227 |
| 3,240,326 | 3/1966 | Miller . | |
| 3,414,927 | 12/1968 | Worcester | 15/104.93 |
| 3,485,349 | 12/1969 | Chaney, Jr. . | |
| 3,608,708 | 9/1971 | Storandt | 15/104.94 |
| 3,619,280 | 11/1971 | Scheuer . | |
| 3,777,328 | 12/1973 | Kaplan | 15/104.94 |
| 3,806,260 | 4/1974 | Miller . | |
| 3,870,150 | 3/1975 | Hummel . | |
| 4,071,921 | 2/1978 | Jury | 15/227 |
| 4,131,195 | 12/1978 | Worrell, Sr. . | |
| 4,220,244 | 9/1980 | Elmore . | |
| 4,347,931 | 9/1982 | Ginger et al. . | |
| 4,427,111 | 1/1984 | Laipply . | |
| 4,575,891 | 3/1986 | Valente | 15/104.93 |
| 4,601,081 | 7/1986 | Sutton et al. | 15/104.94 |
| 4,645,251 | 2/1987 | Jacobs | 294/1.3 |
| 4,959,881 | 10/1990 | Murray | 15/227 |

FOREIGN PATENT DOCUMENTS

| | | | |
|---|---|---|---|
| 261274 | 6/1960 | Australia | 15/227 |
| 68516 | 1/1983 | European Pat. Off. | 15/104.94 |
| 1482990 | 4/1907 | France | 15/227 |

*Primary Examiner*—Mark Spisich
*Attorney, Agent, or Firm*—Nawrocki, Rooney & Silvertson

[57] ABSTRACT

A disposable pad for cleaning a toilet including a mitt-like pad having a cavity to receive a hand, wherein the hand is shielded from contact with the toilet seat. A cleaning pad is fixedly attached and in planar contact with the lower surface of the mitt-like pad and has a cleaning agent absorbed therein. A flap is operatively affixed to the lower surface of the mitt-like pad proximate the cleaning pad and is movable between a first position and a second position. In the first position, the cleaning pad is exposed for cleaning the toilet seat and in the second position, the flap covers the cleaning pad to expose a surface which enables drying of the toilet seat prior to use.

4 Claims, 2 Drawing Sheets

DISPOSABLE TOILET SEAT CLEANING PAD

TECHNICAL FIELD

The present invention relates generally to a disposable cleaning implement. More narrowly, it is directed to a mitt-like disposable pad for cleaning a toilet seat prior to use which incorporates means for both cleaning and drying the toilet seat.

BACKGROUND OF THE INVENTION

Public facilities such as restaurants, schools, service stations, airports, bus terminals, and many other facilities and businesses provide restrooms for use by their customers and the general public. In many areas of the country and the world, the public toilet facilities are not as sanitary as good health practice would require. Often, these restrooms are visibly dirty and, even when the facility has a general appearance of cleanliness, there is no guarantee that germs and bacteria are not present. Thus, a need exists for a cleaning device, with which a user of a public facility can clean the toilet before use.

The need for a disposable toilet seat disinfectant wipe is generally known. For example, Valente (U.S. Pat. No. 4,575,891) discloses a small sterilizing pad device for individually sanitizing a toilet seat. Valente discloses a device with a one-fourth inch moist absorbent swab layer for sterilizing the toilet seat, mounted on a slightly stiff cardboard upper cap having a raisable thumb tab for manipulating the pad over the upper surface of a toilet seat. Valente utilizes a disinfectant solution in the pad to accomplish the cleaning, which he recognizes must be quick-drying to prevent skin irritation. Valente does not disclose a means for drying the toilet seat incorporated into the device.

Sutton et al. (U.S. Pat. No. 4,601,081) disclose a disposable utensil particularly designed for cleaning and disinfecting toilet seats in public restrooms prior to their use. One disclosed embodiment includes multiple pads, one for drying and one for cleaning. These pads are mounted on a rigid handle which increases the length of the device to about six inches. Thus, the devices of Sutton et al. are of a bulkier design which is not readily carried in a woman's purse or a man's pocket or otherwise dispensed in a vending or paper towel machine. The use of a handle prevents direct pressure on the cleaning pad during use. Without the handle the hand would not be shielded from contact with the toilet. The handle is not readily flushable for easy disposal.

Accordingly, a need exists for a disposable pad for cleaning a toilet seat which provide means for cleaning and drying the seat before use and shields the hand from contact with germs or bacteria. The improved toilet seat cleaning device must also be inexpensive, compact, vendable, and, preferably, flushable. The present invention addresses these needs as well as other problems associated with disposable pads for cleaning toilet seats. The present invention also offers further advantages over the prior art and solves other problems associated therewith.

SUMMARY OF THE INVENTION

The present invention is a disposable pad for cleaning a toilet seat. It is specifically designed to include a mitt-like structure which prevents human contact with the surface to be cleaned, and means for both cleaning and drying the toilet seat prior to personal use. The disposable pad is constructed entirely from flexible sheet material so that it is readily folded or rolled into a compact size so that it may readily be packaged and carried in a purse or pocket. The disposable pads may also be dispersed from existing paper towel dispensers or vending machines.

The disposable pad for cleaning a toilet seat includes a mitt-like pad having a cavity to receive a hand. The mitt-like pad shields the hand from contact with the toilet seat and has a lower surface. A cleaning pad is fixedly attached and in planar contact with the lower surface of the mitt-like pad and has a cleaning agent absorbed therein. The cleaning agent may be any known cleaner, disinfectant, sterilizing compound or other sanitizing agent.

A flap is operatively affixed to the lower surface of the mitt-like pad proximate the cleaning pad. The flap has a first position wherein the cleaning pad is exposed for cleaning the toilet seat and a second position where the flap covers the cleaning pad to enable drying of the toilet seat. The disposable pad can have a cleaning pad and flap formed from a single sheet of multi-layer material having at least an upper layer of impervious material which is disposed over a portion of the single sheet in planar contact with the lower surface of the mitt-like pad. In such an embodiment, the single sheet also has at least a lower layer of absorbent material which is fixedly attached to the impervious material over a portion of its surface with the remaining unattached surface forming the flap.

The disposable pad can be rolled or folded to fit into a compact air-tight package which may be dispersed in a vending machine or sold over the counter.

Biodegradable materials which are flushable are preferred in the construction of disposable pads for cleaning toilet seats. Such materials may include paper, gauge, cotton or other biodegradable material such as a biodegradable polymer.

A tab can be fixedly attached to the flap for operatively moving the flap from the first position to the second position without touching the flap. The flap preferably includes a first absorbent layer for drying, a second absorbent layer, which also includes a cleaning agent, and a third impervious layer disposed between said first and second layer.

The mitt-like pad can include an upper sheet and lower sheet with the lower sheet defining an upper and lower surface. The upper sheet is fixedly attached to the upper surface of the lower sheet along at least two edges to form a glove-like cavity to receive a hand and shield it from contact with the toilet seat.

In an alternative embodiment, the mitt-like pad can include an upper sheet and a lower sheet wherein the lower sheet includes a lower layer of absorbent material and an upper layer of barrier material. The lower layer of absorbent material would include the cleaning agent absorbed over at least a portion of the surface of the lower layer.

In this embodiment, the flap is operatively affixed to the lower layer of the lower sheet of material and also has a first position and a second position. When the flap is in the first position, the cleaning agent absorbed over at least a portion of the lower layer is disposed for cleaning, and in the second position, the flap covers the portion of the lower layer on which the cleaning agent has been absorbed so that the flap may be utilized to dry the toilet seat.

These and various other advantages and features of novelty which characterize the present invention are pointed out with particularity in the claims annexed hereto and forming a part hereof. However, for a better understanding of the invention, its advantages, and the objects attained by its use, reference should be made to the drawings which form a further part hereof, and to the accompanying descriptive matter in which there are illustrated and described preferred embodiments of the present invention.

BRIEF DESCRIPTION OF THE DRAWINGS

In the drawings, in which like reference numerals indicate corresponding parts or elements in preferred embodiments of the present invention throughout the several views.

DETAILED DESCRIPTION OF THE INVENTION

As required, detailed embodiments of the present invention are disclosed herein. However, it is to be understood that the disclosed embodiments are merely exemplary of the present invention, which may be embodied in various systems. Therefore, specific details disclosed herein are not to be interpreted as limiting, but rather as a basis for the claims and as a representative basis for teaching one of skill in the art to variously practice the present invention.

Figure 1:
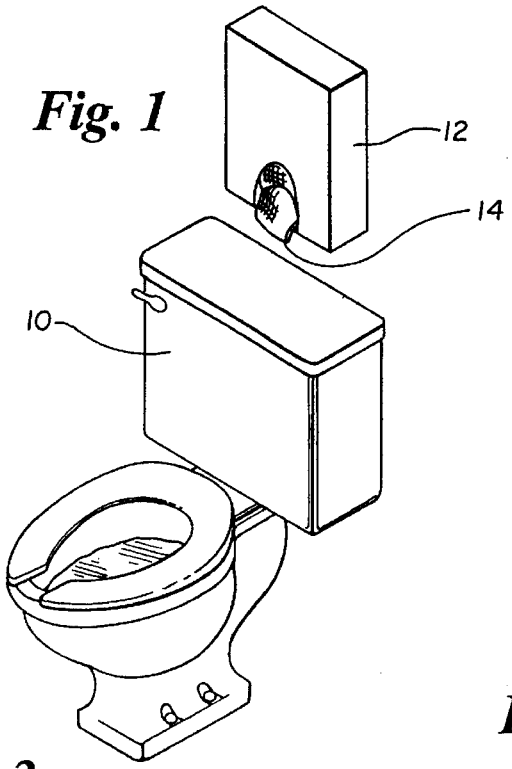
FIG. 1 is a perspective view of the present invention as dispensed in a restroom facility.

Referring now to FIG. 1, an overall perspective view of a disposable pad 14, as dispensed in a vending machine or dispenser 12, is depicted as mounted in a public restroom facility relative to a toilet. As illustrated, the disposable pads 14 of the present invention may be supplied in public restroom facilities, whether free or for a nominal charge, to those who would like to be certain that the seat is sanitary prior to use. The dispenser 12 may be a sealed or air-tight unit from which disposable pads 14 may be dispensed, in stacked or rolled form. With the rolled form, the disposable pads may be readily separable by including perforations between pads, as is well known in the art.

Figure 2:
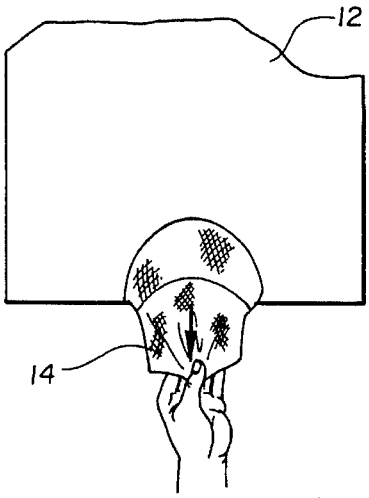
FIG. 2 is a front elevational view of disposable pads of the present invention as dispensed.

FIG. 2 illustrates the way in which disposable pads 14 may be dispensed from the dispenser 12.

Figure 3:
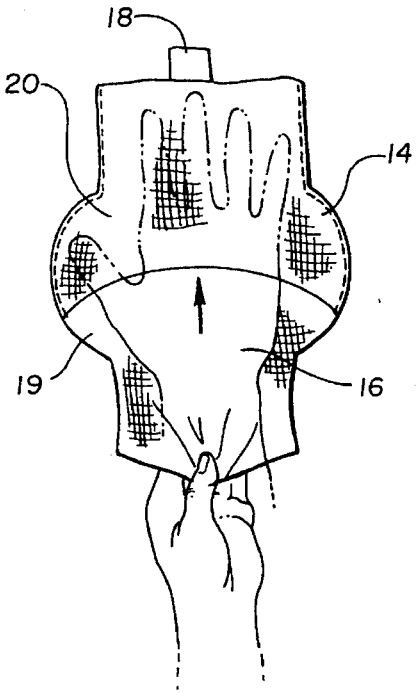
FIG. 3 is a top plan view of a disposable pad of the present invention with a hand inserted therein.
Figure 4:
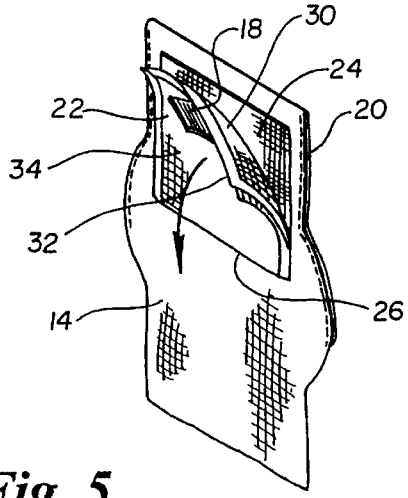
FIG. 4 is a perspective view of a disposable pad of the present invention.

A disposable pad 14 of the present invention is shown in top plan view in FIG. 3 and in perspective view in FIG. 4. As illustrated in these figures, the disposable pad 14 comprises a mitt-like pad including an upper sheet 20 and a lower sheet 19. The lower sheet defines an upper and lower surface on that sheet. The upper sheet 20 is attached to the upper surface of the lower sheet 19 on at least two edges to form a glove-like cavity to receive a hand 16.

As is illustrated, the glove-like or mitt-like cavity protects the hand from exposure to the surface of the toilet seat when cleaning or dyring the seat. In a preferred embodiment, the shape of the mitt-like cavity is such that a space is provided for the thumb of a right-handed or left-handed person which prevents the disposable pads from sliding off of the hand during use.

A cleaning pad 24 is fixedly attached and in planar contact with the lower surface of the lower sheet 19. The cleaning pad 24 has absorbed therein a cleaning agent. The cleaning agent can be any disinfecting, sanitizing, antibacterial, germicidal, or other cleaning agent suitable for sanitizing the surface of the toilet seat. Such cleaning agents are well-known in the art and available under a multiplicity of trade names. Such known chemicals as isopropyl alcohol could also be utilized.

A flap 22 is operatively affixed to the lower surface of the lower sheet 19 proximate the disinfecting pad 24. The flap 22 can be attached along one edge 26 parallel to and in contact with one edge of the disinfecting pad 24.

Figure 6:
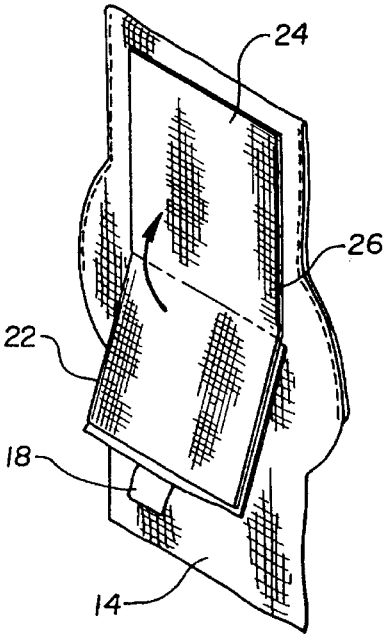
FIG. 6 is a perspective view of a disposable pad of the present invention illustrating flap positioning.

The flap 22 has a first position and a second position. These positions are best understood and illustrated in FIG. 4 and FIG. 6. In the first position, as depicted in FIG. 6, the flap 22 is folded back, to expose the cleaning pad 24 by folding along the line of flap attachment 26, in a preferred embodiment. A tab 18 can be fixedly attached to the flap 22 to facilitate moving the flap 22 from the first position to the second position or vice-versa without hand contact with the flap 22.

In the second position, as depicted in FIG. 4, the flap 22 is folded over and covers the cleaning pad 24 so that the surface of the flap now exposed and the exposed area of the lower sheet 19 may be utilized to dry the toilet seat.

The flap 22 can have multiple layers. The flap 22 can have a first layer of absorbent material 30 exposed in the first position may also include the cleaning agent, just as in the cleaning pad 24. The flap 22 can have a second layer 34 which is exposed in the second position, containing an absorbent material for drying. These layers can be separated by an impervious or barrier layer 32.

Figure 5:
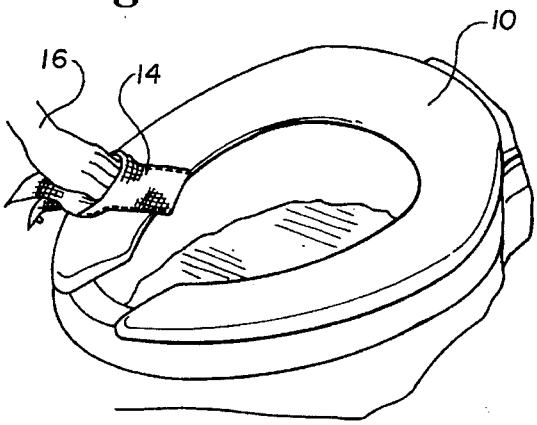
FIG. 5 is a perspective view of a disposable pad of the present invention in use during cleaning.
Figure 7:
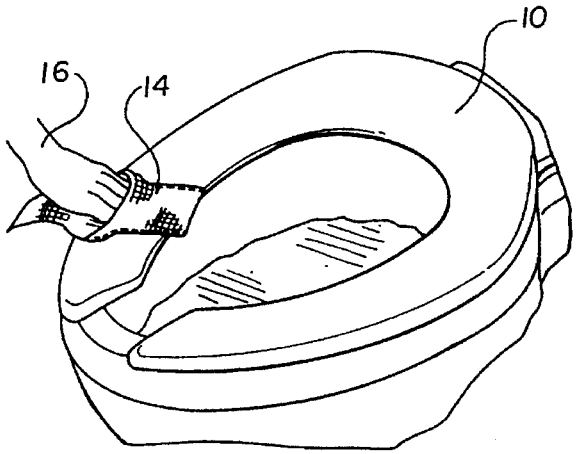
FIG. 7 is a perspective view of a disposable pad of the present invention during drying of the toilet seat.

In use, as illustrated in FIG. 5, the flap 22 is located in the first position so that the cleaning pad 24 is exposed. The disposable pad 14 with the hand 16 inserted therein, is then used to clean the seat of a toilet 10. Subsequent to sanitizing the toilet seat with the cleaning agent included in the cleaning pad 24, the flap 22 is moved to the second position, wherein the cleaning pad 24 is covered by the flap 22. As shown in FIG. 7, the disposable pad 14 with the hand 16 still inserted therein is utilized to dry the seat of the toilet 10. The cleaning pad 24 and flap 22 may be formed from a single sheet of multi-layered material having at least an upper layer of impervious material 32 disposed over a portion of the sheet in planar contact with the lower surface 19 of the mitt-like pad. The single sheet also includes at least a lower layer of absorbent material 30 which is fixedly attached to the impervious material 32 over a portion of its surface with the remaining unattached surface forming the flap 22.

The disposable pad 14 may be packaged in an air-tight disposable wrapper manufactured from such compounds as cellophane, aluminum foil or another polymeric material.

Preferably, the materials utilized to manufacture the disposable pad 14 are biodegradable, and readily flushable in a toilet 10. These materials may include paper or a biodegradable polymer.

Figure 8:
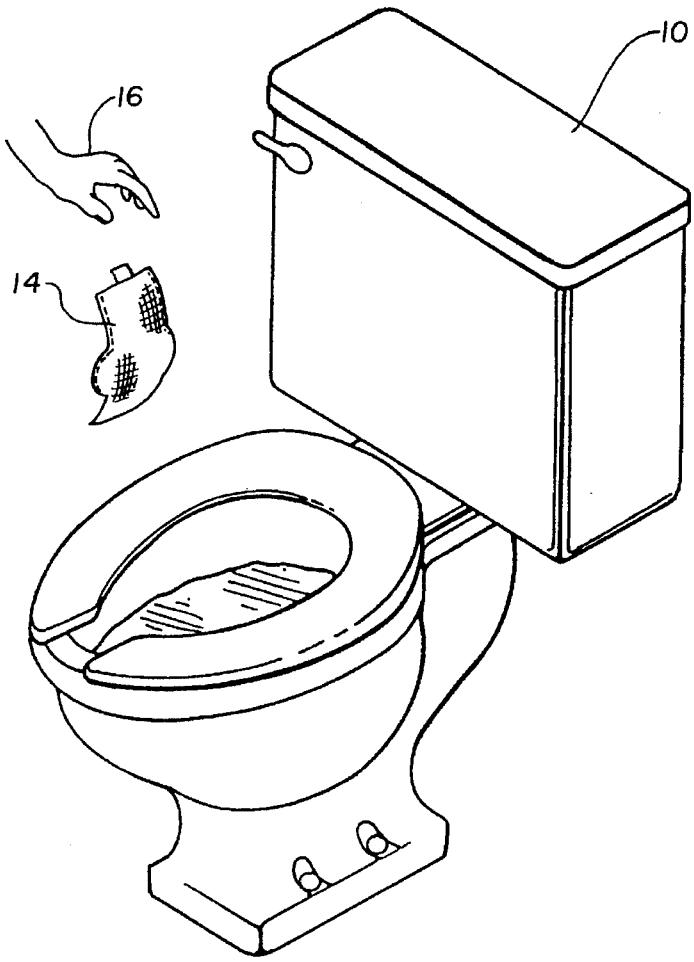
FIG. 8 is a perspective view of a flushable pad of the present invention as disposed.

In another embodiment, the disposable pad 14 may include a mitt-like pad which has an upper sheet 20 and a lower sheet 19, wherein the lower sheet 19 includes a lower layer of absorbent material and an upper layer of barrier material. The lower layer of absorbent material can include the cleaning agent absorbed over at least a portion of the lower layer. This embodiment utilizes the surface of the mitt-like pad as a cleaning pad 24, rather than affixing a separate pad to the surface. Again, in this embodiment, a flap 22 is operatively affixed to the lower layer of the lower sheet 19 and is movable to a first position and a second position. In the first position, the cleaning agent absorbed over at least a portion of the lower layer is exposed. In the second position, the cleaning agent absorbed over at least a portion of the lower layer is covered by the flap to enable drying of the toilet seat. Finally, in FIG. 8, the disposable pad 14 is illustrated being discarded in a toilet 10 after use.

New characteristics and advantages of the invention covered by this document have been set forth in the foregoing description. It will be understood, however, that this disclosure is, in many respects, only illustrative. Changes may be made in details, particularly in matters of shape, size, and arrangement of parts, without exceeding the scope of the invention. The scope of the invention is, of course, defined in the language in which the appended claims are expressed.

What is claimed is:

1. A disposable pad for cleaning a toilet seat comprising:

(a) a mitt-like pad having a cavity to receive a hand, wherein said hand is shielded from contact with said toilet seat, said mitt-like pad having a lower surface;

(b) a cleaning pad having a planar surface fixedly attached and in planar contact with said lower surface, said cleaning pad having a cleaning agent absorbed therein; and (c) a flap operatively affixed to said lower surface, proximate said cleaning pad, having a first position wherein said cleaning pad is exposed for cleaning said toilet seat and a second position wherein the flap covers said cleaning pad to enable drying said toilet seat wherein said cleaning pad and said flap are formed from a single sheet of multi-layer material, said single sheet including at least an upper layer of impervious material disposed over a portion of said single sheet in planar contact with the lower surface of said mitt-like pad and at least a lower layer of absorbent material fixedly attached to said impervious material over a portion of its surface, with a remaining unattached surface forming said flap.

2. A disposable pad for cleaning a toilet seat comprising:

(a) a mitt-like pad having a cavity to receive a hand, wherein said hand is shielded from contact with said toilet seat, said mitt-like pad having a lower surface;

(b) a cleaning pad having a planar surface fixedly attached and in planar contact with said lower surface, said cleaning pad having a cleaning agent absorbed therein; and (c) a flap operatively affixed to said lower surface, proximate said cleaning pad, having a first position wherein said cleaning pad is exposed for cleaning said toilet seat and a second position wherein the flap covers said cleaning pad to enable drying said toilet seat, wherein said flap includes a first absorbent layer, an impervious layer and a second absorbent layer wherein said impervious layer is disposed between said first and second absorbent layers.

3. A disposable pad for cleaning a toilet seat comprising:

(a) a mitt-like pad including an upper sheet and a lower sheet having an upper and a lower surface and edges around the perimeter thereof, said upper sheet fixedly attached to the upper surface of said lower sheet along at least two edges to form a mitt-like cavity between a lower surface of the upper sheet and the upper surface of the lower sheet to receive a hand, wherein in use said hand is shielded from contact with said toilet seat;

(b) a cleaning pad having a planar surface fixedly attached and in planar contact with said lower surface of said lower sheet, said cleaning pad having a cleaning agent absorbed therein; and (c) a flap operatively affixed to said lower surface of said lower sheet proximate said cleaning pad, said flap having a first position and a second position, wherein in said first position the cleaning pad is exposed for cleaning and in said second position, the cleaning pad is covered by said flap to enable drying of said toilet seat wherein said cleaning pad and said flap are formed from a third single sheet of multi-layer material, said single sheet including at least an upper layer of impervious material disposed over a portion of said sheet in planar contact with said lower surface of said mitt-like pad and at least a lower layer of absorbent material fixedly attached to said impervious material over a portion of its surface with a remaining unattached surface forming said flap.

4. A disposable pad for cleaning a toilet seat comprising:

(a) a mitt-like pad including an upper sheet and a lower sheet having an upper and a lower surface and edges around the perimeter thereof, said upper sheet fixedly attached to the upper surface of said lower sheet along at least two edges to form a mitt-like cavity between a lower surface of the upper sheet and the upper surface of the lower sheet to receive a hand, wherein in use said hand is shielded from contact with said toilet seat;

(b) a cleaning pad having a planar surface fixedly attached and in planar contact with said lower surface of said lower sheet, said cleaning pad having a cleaning agent absorbed therein; and (c) a flap operatively affixed to said lower surface of said lower sheet proximate said cleaning pad, said flap having a first position and a second position, wherein in said first position the cleaning pad is exposed for cleaning and in said second position, the cleaning pad is covered by said flap to enable drying of said toilet seat, wherein said flap includes a first absorbent layer, an impervious layer and a second absorbent layer, wherein said impervious layer is disposed between said first and second absorbent layers.

* * * * *